United States Patent [19]

Meckler et al.

[11] 4,171,624

[45] Oct. 23, 1979

[54] AIR CONDITIONING APPARATUS

[75] Inventors: Gershon Meckler, Bethesda, Md.; Milton Meckler, Sepulveda, Calif.

[73] Assignee: Gershon Meckler Associates, P.C., Washington, D.C.

[21] Appl. No.: 837,879

[22] Filed: Sep. 29, 1977

Related U.S. Application Data

[63] Continuation of Ser. No. 677,694, Apr. 16, 1976, abandoned.

[51] Int. Cl.[2] ..... F25D 23/00; F25B 7/00; F25B 15/00

[52] U.S. Cl. ..... 62/271; 62/335; 62/476

[58] Field of Search ..... 62/335, 476, 112, 271

[56] References Cited

U.S. PATENT DOCUMENTS

| | | | |
|---|---|---|---|
| 2,182,453 | 12/1939 | Sellew | 62/335 |
| 3,350,892 | 11/1967 | Kelley | 62/271 |
| 3,417,574 | 12/1968 | Kelley | 62/271 |
| 3,605,432 | 9/1971 | Wada | 62/476 |
| 3,817,046 | 6/1974 | Aoki | 62/476 |
| 4,081,024 | 3/1978 | Rush et al. | 62/271 |

*Primary Examiner*—Lloyd L. King
*Attorney, Agent, or Firm*—John C. Purdue

[57] ABSTRACT

Air conditioning apparatus is disclosed. The apparatus includes a thermal compressor which is used to regenerate an aqueous hygroscopic liquid, e.g., a solution of lithium chloride or lithium bromide in water. The regenerated hygroscopic liquid is used both for humidity control in air conditioning apparatus and to absorb water that has been vaporized in an evaporator, thereby enabling the evaporation of further water in the evaporator and the use of water as a refrigerant. In one disclosed embodiment, a molecular still is used in connection with the operation of the thermal compressor.

15 Claims, 5 Drawing Figures

AIR CONDITIONING APPARATUS

This is a continuation of application Ser. No. 677,694 filed Apr. 16, 1976, now abandoned.

BACKGROUND OF THE INVENTION

Chemical dehumidifiers wherein a liquid desiccant, for example an aqueous glycol solution or a solution of lithium chloride or lithium bromide in water is used to remove moisture vapor from air being conditioned have long been available. Although chemical dehumidifiers of the indicated type are advantageous in operations of many types, their comparatively high energy requirements, particularly for regeneration of the liquid desiccant, have rather severely restricted their use. Furthermore, when the desiccant solution is heated to cause vaporization of water therefrom and consequent regeneration, the consequence is hot, concentrated hygroscopic solution. Since the ultimate use in dehumidification requires the hygroscopic solution to be at a comparatively low temperature, energy is also required to transfer heat from the regenerated solution.

Thermal compressors, wherein water is vaporized at a low pressure and at a comparatively low temperature from a thin film flowing along a thin separating member, and is condensed at a slightly higher temperature and pressure on the opposite side of the separating member are known*. Concentrated salt solution and condensed water are separately collected. Thermal compressors have been suggested for use in releasing fresh water from sea water and other brine sources, so that the concentrated salt solution has ordinarily been discarded, or used as a feedstock for a salt recovery process, while the condensed water has been the desired end product.

*See, for example, U.S. Pat. No. 2,734,023 and "Sea Water Converter: Metal Sheet Evaporates Water and Condenses Vapor", *Machine Design*

BRIEF DESCRIPTION OF THE INVENTION

The instant invention is based upon the discovery of air conditioning apparatus wherein a thermal compressor is used in combination with refrigerating apparatus, dehumidifying apparatus or combined refrigerating and dehumidifying apparatus, which apparatus utilizes an aqueous hygroscopic solution that is diluted in use. The thermal compressor is used to regenerate the hygroscopic solution, and is peculiarly advantageous because of significant energy savings by comparison with regenerating apparatus that has previously been employed.

DETAILED DESCRIPTION OF THE INVENTION

Figure 1:
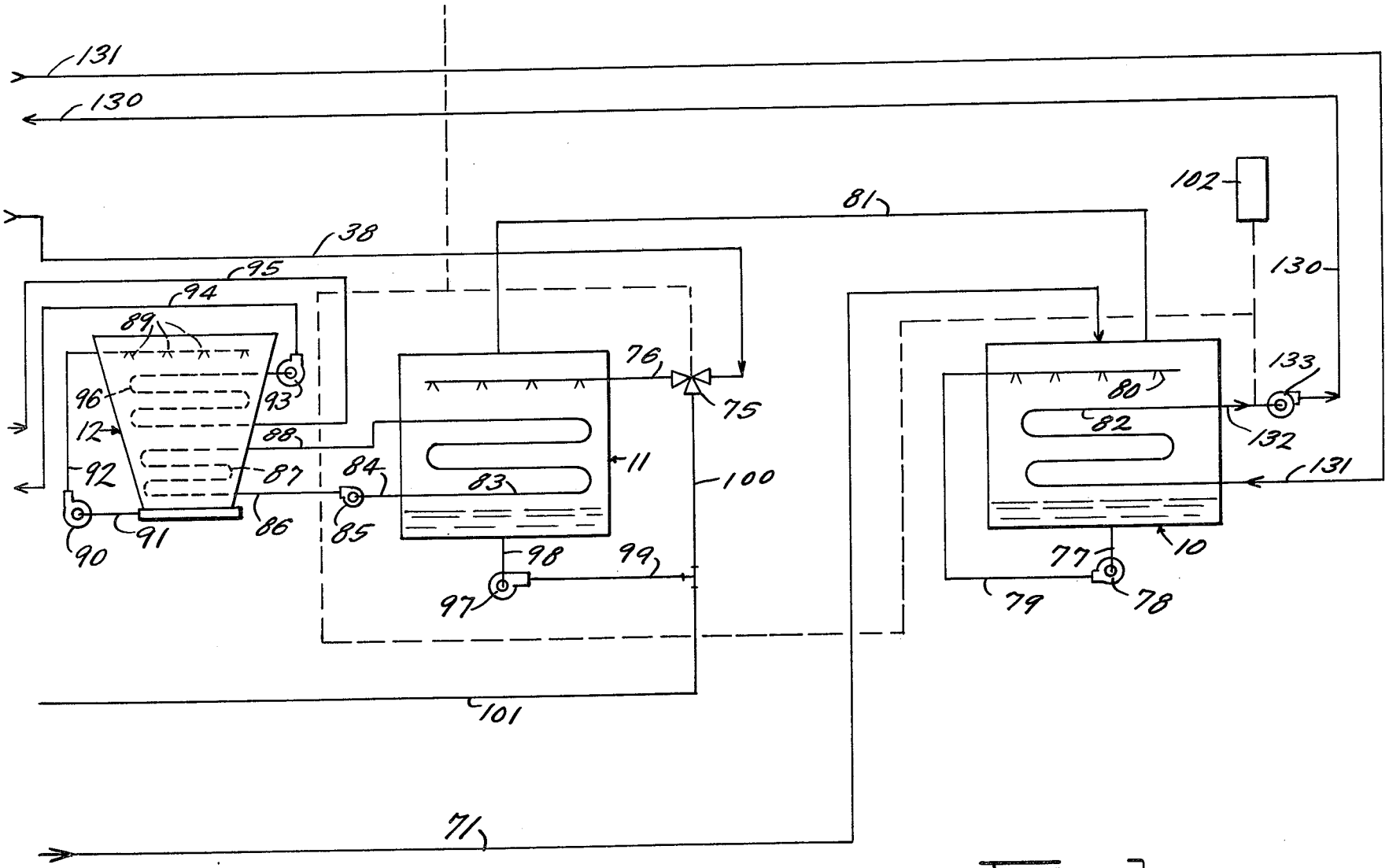
FIGS. 1 and 2, combined, constitute a schematic flow diagram of an embodiment of the instant invention wherein an aqueous hygroscopic solution is used as a part of refrigerating apparatus and also as a part of dehumidifying apparatus, and wherein a thermal compressor is used for regeneration of the hygroscopic solution.
Figure 2:
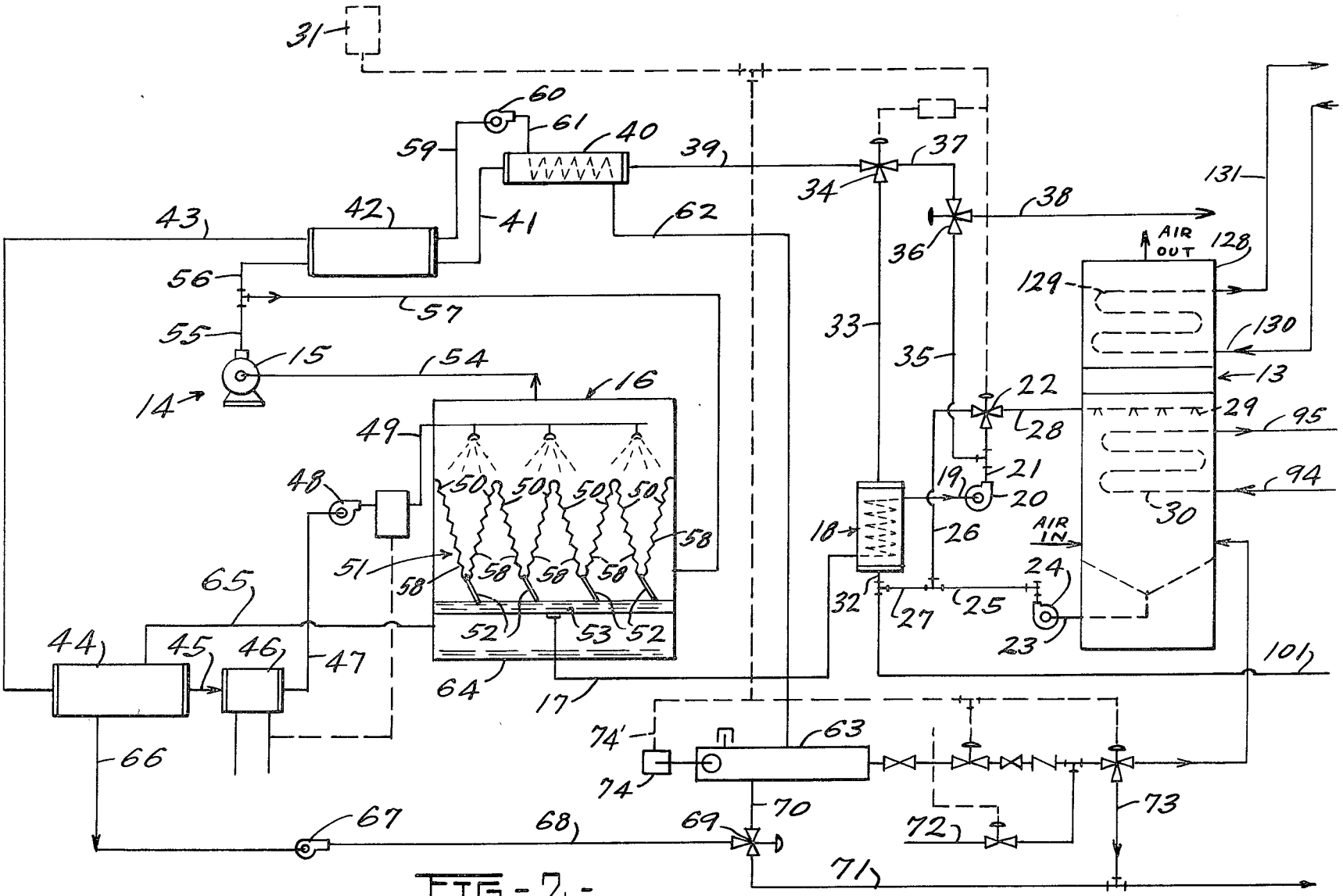

Referring to FIGS. 1 and 2, air conditioning apparatus shown schematically comprises (FIG. 1) an evaporator 10, an absorber 11, an evaporative cooler 12, air conditioning apparatus indicated generally at 13 (FIG. 2) and a thermal compressor indicated generally at 14 and comprising, as its principal components, a compressor 15 and a heat exchanger 16.

In operation, a concentrated aqueous hygroscopic solution, e.g., of lithium chloride or lithium bromide in water, is circulated from the heat exchanger 16 through a line 17, a heat exchanger 18, a line 19, a pump 20 and a line 21 to a three-way valve 22. Dilute aqueous hygroscopic solution is circulated from a dehumidification part of the apparatus 13 through a line 23 by a pump 24 to a line 25 from which its flow is divided between a line 26 and a line 27. Dilute hygroscopic solution from the line 26 is delivered to the three-way valve 22 where it is mixed with concentrated hygroscopic solution from the line 21; the mixture of dilute hygroscopic solution and concentrated hygroscopic solution which results flows from the valve 22 through a line 28, and is sprayed from nozzles 29 over a coil 30. Air to be conditioned is circulated in a conventional manner as indicated by an arrow and legend through the apparatus 13 where it is dehumidified by the hygroscopic solution and then sensibly cooled, as subsequently explained. Air from the apparatus 13 is circulated, also as indicated by an arrow and legend, to the space to be air conditioned. The three-way valve 22, in the specific embodiment of the invention illustrated is controlled by a humidistat 31. The humidistat 31 senses the humidity in the space being air conditioned, and increases or decreases the proportion of concentrated hygroscopic solution delivered to the line 28 in response, respectively, to a signal indicating too high or too low a humidity in the space.

Dilute hygroscopic solution from the line 27 flows into a line 32, through the heat exchanger 18 in indirect heat exchange relationship with concentrated hygroscopic liquid flowing therethrough from the line 17 to the line 19, and, through a line 33 to a three-way valve 34. Concentrated hygroscopic liquid from the line 21 can bypass the valve 22, flowing through a line 35 to a three-way valve 36 and, from thence, through a line 37 to the three-way valve 34 or to a line 38, for a purpose subsequently described.

Dilute hygroscopic liquid, or a mixture of dilute and concentrated hygroscopic liquid, flows from the valve 34 through a line 39, an indirect heat exchanger 40, a line 41, an indirect heat exchanger 42, a line 43, an indirect heat exchanger 44, a line 45, a heat stabilizer 46, a line 47, a pump 48 and a line 49 to the heat exchanger 16. More or less dilute hygroscopic solution delivered to the heat exchanger 16 flows downwardly therein in a thin film over facing sides 50 of a heat exchange surface 51, and through drain lines 52 to a sump 53. It is from the sump 53 that concentrated aqueous hygroscopic solution is delivered to the line 17 as previously described.

The sides 50, and, consequently, the thin films of more or less dilute hygroscopic solution flowing thereon, are subjected to a vacuum by virtue of being connected through a line 54 to the inlet side of the compressor 15. The compressor 15 discharges into a line 55, from which the effluent is divided between a line 56 and a line 57. The compressor effluent, mainly water vapor from the line 57, is discharged into the heat exchanger 16 in contact with sides 58 of the heat exchange surface 51. Because of the higher pressure on the sides 58 of the surface 51, and despite the slightly higher temperature, water vapor is condensed on the sides 58, the heat of vaporization being absorbed by the wall 51 and transferred therethrough to the thin film of hygroscopic solution flowing down the sides 50, thereby causing the desired vaporization of water. Water vapor which is not required in the heat exchanger 16 flows through the line 56, the indirect heat exchanger 42, a line 59, a pump 60, a line 61, the indirect heat exchanger 40, and a line 62 to a storage tank 63.

Water which is condensed on the sides 58 of the surface 51 collects in a sump 64, from whence it flows through a line 65, the indirect heat exchanger 44, a line 66, a pump 67 and a line 68 to a three-way valve 69. Depending upon need, water can flow from the three-way valve 69 through a line 70 to the tank 63 or through a line 71 to be used as make-up water, as subsequently explained in more detail. Depending upon requirements, make-up water can enter the system through a line 72 from a source (not illustrated) or excess water can be discharged from the system through a line 73. As suggested by a schematically represented float controlled valve 74 and a dotted line 74 representing a control circuit, the discharge of excess water and the introduction of make-up water can, if desired, be controlled automatically in any suitable manner which is not a part of the instant invention.

Concentrated hygroscopic solution in the line 38 flows to a three-way valve 75 (FIG. 1) and from thence through a line 76 from which it is sprayed within the absorber 11. Water is pumped from a sump in the evaporator 10 through a line 77, a pump 78, a line 79 and nozzles 80 from which it is sprayed within the evaporator 10. The evaporator 10 is connected by a line 81 to the absorber 11. As a consequence of the spraying of the more or less concentrated hygroscopic solution from the line 76, the interior of the absorber 11 is a region of low humidity; this causes a flow of water vapor thereto through the line 81 from the evaporator 10. This flow of water vapor from the evaporator 10 through the line 81 enables further evaporation of water sprayed from the nozzles 80, and a continuing refrigerating effect. Chilled water is circulated from a coil 82 within the evaporator 10, flowing to the apparatus 13 (FIG. 2), as subsequently described in detail.

Heat is removed from the absorber 11 by means of a coil 83 positioned interiorly thereof. Cooling water is circulated through the coil 83, flowing therefrom through a line 84, a pump 85, and through a line 86 to a coil 87 within the indirect heat exchanger 12. Water returns to the coil 83 from the coil 87, flowing through a line 88. Cooling water circulating within the coil 87 is cooled evaporatively. Water is sprayed from nozzles 89 into air flowing upwardly through the indirect heat exchanger 12. Water for evaporative cooling is recirculated within the evaporative cooler 12 by a pump 90, flowing from the bottom of the evaporative cooler 12 through a line 91 and the pump 90 to a line 92 from which it is delivered to the nozzles 89. Make-up water is supplied to the evaporative cooler 12 in any suitable manner (not illustrated). In operation, heat from the coil 30 of the dehumidifier 128 is transferred to air and water in the cooler 12 and exhausted therefrom to atmosphere as a heat sink.

Water is also circulated from the evaporative cooler 12 by a pump 93 through a line 94 to the coil 30 (FIG. 2) where the heat of sorption incident to dehumidification is transferred thereto. Water leaving the coil 30 flows through a line 95 to a coil 96 (FIG. 1) in the cooler 12 where it is evaporatively cooled.

Dilute hygroscopic solution is circulated from the absorber 11 by a pump 97, flowing through a line 98 and the pump 97 to a line 99 from which the flow is divided between a line 100 and a line 101. The three-way valve 75 is controlled in response to a temperature, for example the temperature of conditioned air being delivered by the apparatus, which it is desired to control. This temperature is sensed by a temperature sensor 102, which controls the three-way valve 75 to increase or decrease the proportion of dilute hygroscopic solution which flows from the pipe 100 to the pipe 76 when the temperature sensed is, respectively, below or above the control temperature. Dilute hygroscopic liquid which is not delivered to the line 75 returns through the line 101 from which it flows into the line 32 (FIG. 2) and, from thence, as previously described for regeneration.

Figure 3:
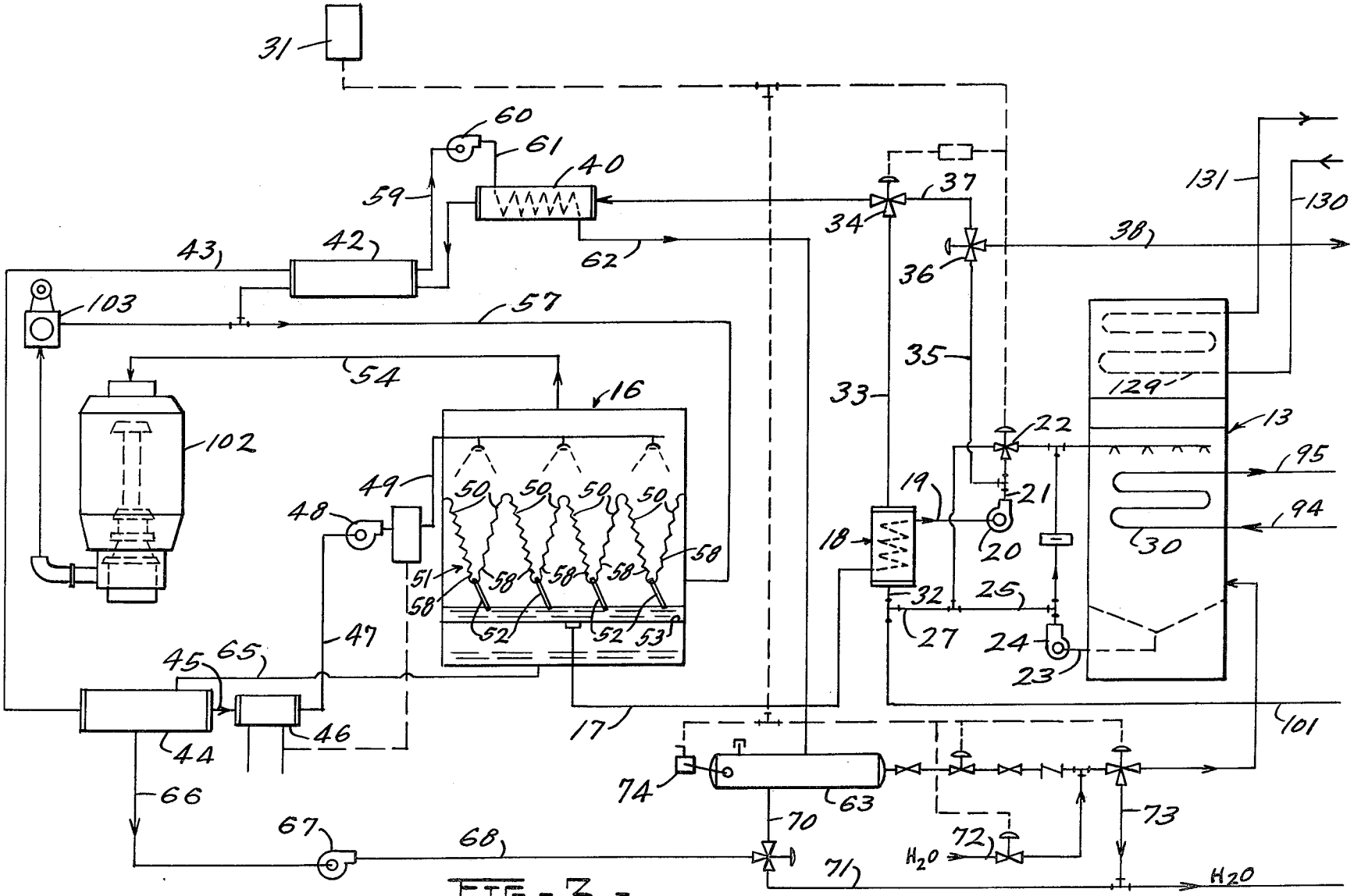
FIG. 3 is a schematic diagram showing a modification of the FIG. 2 portion of the apparatus of FIGS. 1 and 2 wherein a diffusion pump is used in connection with the operation of the thermal compressor.

Referring to FIG. 3, apparatus is shown which is substantially identical, as indicated by use of the same reference numerals, to that shown in FIG. 2 except that a diffusion pump 102 and an associated roughing pump 103 have been substituted for the compressor 15 of the FIG. 2 apparatus. The diffusion pump 102 can be,for example, of the type shown in U.S. Pat. Nos. 1,367,865; 1,320,874 or 2,080,421. Heat for the diffusion pump can be furnished by hot water circulated thereto from a storage tank (not illustrated in FIG. 3) heated by any suitable means. The apparatus of FIG. 3 can, like the apparatus of FIG. 1, as previously described, constitute a part of dehumidification and cooling apparatus, the rest of such apparatus being shown in FIG. 2. Alternatively, the apparatus of FIG. 3 can, as subsequently described in more detail, be used in combination with other apparatus to accomplish both dehumidification and cooling.

The apparatus of FIGS. 1 and 2 has a high "coefficient of performance", by comparison with previously known refrigeration apparatus which can be powered by thermal energy. The coefficient of performance of refrigeration apparatus is the net heat extracted, usually expressed in BTU's per pound of refrigerant divided by the work required to enable the extraction of that amount of heat, expressed in the same units. The theoretical coefficient of performance of compression refrigeration apparatus using ammonia as the refrigerant, and operating between an evaporator pressure of 35 pounds per square inch absolute and a condenser pressure of 160 pounds per square inch absolute is 5.097. Because of friction, inertia and heat losses, the actual coefficient of performance of compression refrigeration apparatus is approximately 4. Absorption refrigeration apparatus characteristically has a substantially lower coefficient of performance, e.g. about 0.65 to 0.7, than does compression apparatus. However, the energy requirements for absorption refrigeration apparatus cannot be compared with those of compression apparatus on the basis of coefficient of performance alone, because absorption apparatus requires principally heat, while compression apparatus requires shaft work. Since fuels can be used to provide heat more efficiently than they can be used to provide shaft work, absorption apparatus may, in some cases, actually require less ultimate fuel, e.g. coal, oil or gas, than compression apparatus.

Chemical dehumidification, e.g. using an aqueous solution of lithium chloride or of a glycol, as heretofore practiced to remove moisture vapor from air has had an extremely low coefficient of performance, usually ranging from 0.25 to 0.4. The energy requirements for regeneration of the aqueous hygroscopic solution have contributed in a major way to the low coefficient of performance, and the need to remove heat from the regenerated hygroscopic solution before it could be used for further dehumidification has also been a factor.

Referring to FIGS. 1 and 2, the compressor 15 can be operated to maintain an absolute pressure of 360 mm. mercury on the facing sides 50 of the heat exchange surface 51 and an absolute pressure of 1660 mm. mercury on the sides 58 of the heat exchange surface 51. From the "Steam Tables" the temperature on the sides 58 will be 254° F. When the hygroscopic solution used is an aqueous solution of lithium chloride, a temperature of 254° F. on the sides 58 will enable evaporation of water from the solution on the facing sides 50 of the heat exchange surface 51 at a temperature of 250° F., and will provide an aqueous solution containing 45 percent by weight of lithium chloride in the sump 53 for delivery to the line 17. Such a lithium chloride solution can be used to maintain a 43 weight percent lithium chloride solution flowing over the coil 30 of the apparatus 13. With such a solution, outside air having a dry bulb temperature of 95° F. and containing 98 grains of water vapor per pound of dry air can be dehumidified to a water vapor content of 45 grains per pound of dry air. To accomplish such dehumidification water at a temperature of about 85° F. should be circulated through the coil 30 to maintain a lithium chloride solution temperature of about 97° F. Conditioned air at a dry bulb temperature of about 97° F. enters a chiller portion 128 of the air conditioning apparatus 13 where it is sensibly cooled to a temperature sufficiently low to enable it to compensate for sensible heat gains in the space to be air conditioned. The sensible cooling is accomplished by contact between the air being conditioned and a sensible coil 129. Chilled water from a line 130 is circulated through the coil 129, and discharged therefrom into a line 131. The line 131 delivers return water to the coil 82 of the evaporator 10, where it is again chilled before flowing from the coil 82 through a line 132 and a pump 133 to the line 130. The evaporator 10 can be operated, for example, so that water at a temperature of about 45° F. flows through the line 130 to the coil 129 (FIG. 2). When the apparatus is operated in this manner the air leaving the air conditioning apparatus 13 can have a dry bulb temperature of about 60° F. and can contain 45 grains of water vapor per pound of dry air. Conditioning air to these conditions requires chilled water at a temperature of about 45° F. in the coil 129 of the conditioning apparatus 13. The conditions of the air, including dry bulb temperature, grains of water per pound of dry air and enthalpy, entering the conditioning apparatus 13, leaving the coil 30 of the apparatus 13, and leaving the apparatus 13 are set forth in the following Table:

| | Dry Bulb Temp. °F. | Grains Water Per Pound Dry Air | Enthalpy, Btu per pound dry air |
|---|---|---|---|
| Outside air | 95 | 98 | 38 |
| Air leaving the coil 30 | 97 | 45 | 31 |
| Air leaving the air conditioning apparatus 13 | 60 | 45 | 22 |

It is often advantageous to produce conditioned air having a moisture vapor content of fewer than 48 grains per pound of dry air. This can readily be accomplished by adding a second stage of chemical dehumidification, as has been done in the apparatus of FIG. 4. This apparatus includes a blower 128 having an inlet 129 for air to be conditioned. Air from the blower 128 passes through a duct 230 into a chemical dehumidifier 231, from thence through a duct 232 to a chemical dehumidifier 233 and, thence, through a duct 234, an evaporative cooler 235 and a duct 236 to a space (not illustrated) to be air conditioned.

In the chemical dehumidifier 231 the air flows countercurrent to, and in direct contact with, a hygroscopic liquid, e.g. an aqueous solution of lithium chloride, which is sprayed downwardly from nozzles 137 over a coil 138 within the dehumidifier 232. The coil 138 is shown receiving cooling water from a line 94, and returning water to a line 95. These are the lines 94 and 95 of FIG. 1 which serve the coil 96 of the evaporative cooler 12 where heat of sorption from the dehumidifier 231 (FIG. 5) by a hygroscopic liquid, e.g., a 45 weight percent solution of lithium chloride in water, as furnished to the nozzles 137 from a thermal compressor indicated generally at 139 in the manner previously discussed in connection with FIG. 2, is transferred from the apparatus. The thermal compressor 139 (FIG. 5) can be operated in the manner previously described to supply the 45 weight percent solution of lithium chloride to the nozzles 137; this will provide a 43 percent solution over the coil 138, and cooling water can be furnished to maintain a solution temperature within the dehumidifier 131 of 97° F. When operated under these conditions, the dehumidifier 131 can receive outside air having a dry bulb temperature of 95° F. and containing 98 grains of water vapor per pound of dry air, and will deliver to the duct 132 air having a dry bulb temperature of 97° F. and containing 45 grains of water vapor per pound of dry air. Such air can be further dehumidified and sensibly cooled in the dehumidifier 133.

Figure 4:
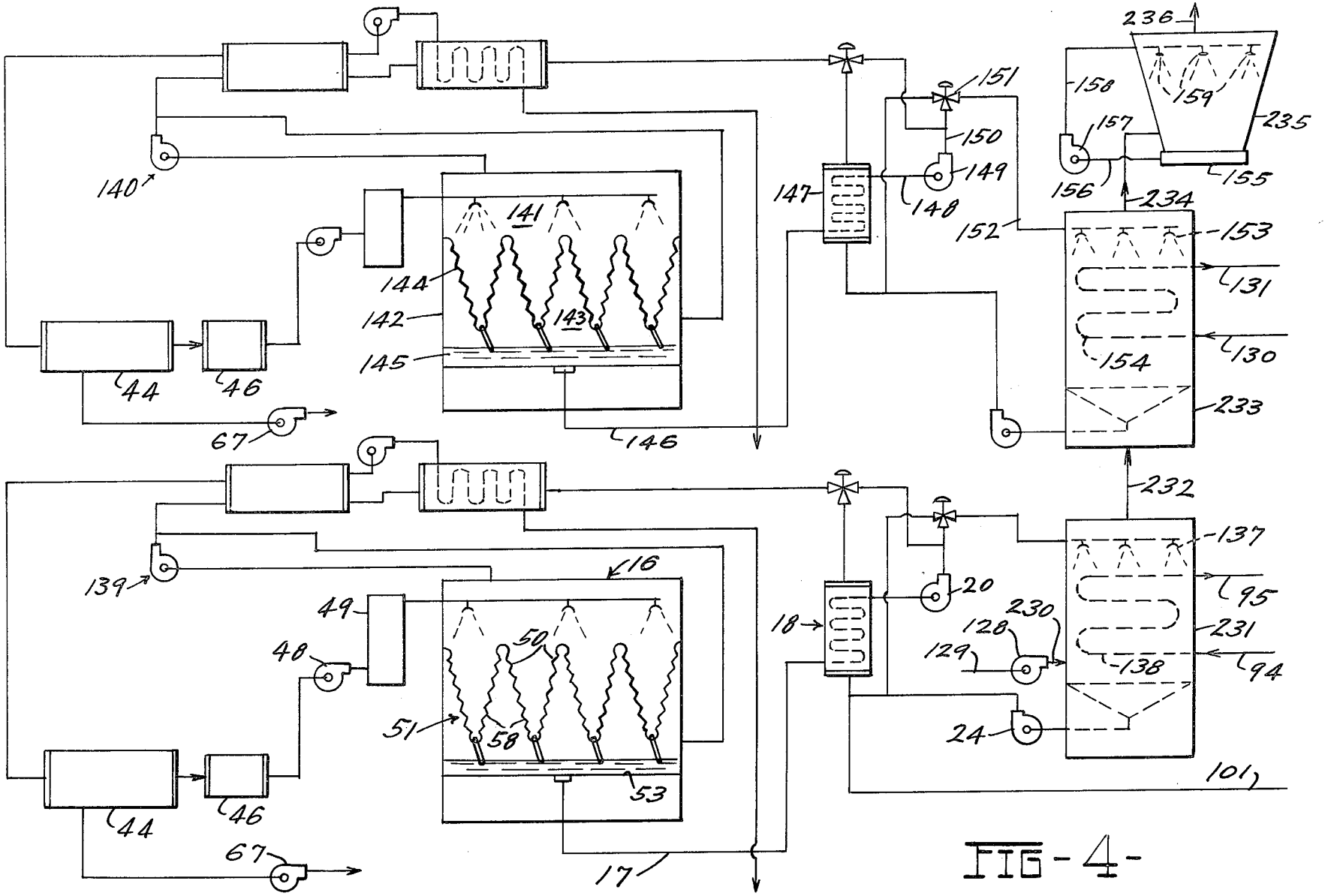
FIG. 4 is a schematic diagram showing a modification of the FIG. 2 portion of the apparatus of FIGS. 1 and 2 wherein a second stage of dehumidification and a humidifier are substituted for a sensible cooling coil.

The FIG. 4 apparatus also includes a second thermal compressor, indicated generally at 140, to serve the dehumidifier 133. The thermal compressor 140 can be operated to maintain an absolute pressure of 560 mm. mercury on an evaporator side 141 of a heat exchanger 142 and an absolute pressure of 1660 mm. mercury on a condensing side 143 of the heat exchanger 142. These pressures will cause a temperature of 250° F. on the evaporator side 141 of a heat exchange surface 144, and a temperature of 254° F. on the condenser side 143 of the heat exchange surface 144. At the indicated pressures and temperatures, a 37 weight percent solution of lithium chloride will collect in a sump 145 of the heat exchanger 142 and can be circulated through a line 146, a heat exchanger 147, a line 148, a pump 149, and a line 150 to a three-way valve 151. The three-way valve controls the flow of lithium chloride solution through a line 152 to nozzles 153 from which it is sprayed over a coil 154 in the dehumidifier 133. The three-way valve 151 controls the flow of lithium chloride solution to maintain a concentration of 35 weight percent lithium chloride in the liquid flowing over the coil 154. Chilled water is circulated through the coil 154 from a supply line 130 (FIG. 1) and to a return line 131. As previously discussed, this chilled water is from the coil 82 in the evaporator 10. By controlling the evaporator 10 so that it supplies chilled water at about 45° F. and operating the dehumidifier 133 (FIG. 4) as previously described, air can be conditioned therein and furnished thereby to the duct 134 at a dry bulb temperature at 60° F., and containing 32 grains of water vapor per pound of dry air. Frequently, conditioned air containing only 32 grains of water vapor per pound of dry air is "dryer" than is necessary, at the rate of air flow being used for conditioning, to provide humidity control. When this is true, moisture can be added to the conditioned air in the humidifier 135 by circulating water from a sump 155 through a line 156 to a blower 157, and from thence through a line 158 to nozzles 159. The rate at which water is sprayed from the nozzles 159 is controlled to provide the requisite combination of dry bulb temperature and moisture vapor content in the air delivered to the space from the duct 136. When the apparatus is operated as described above, this can range from a dry bulb temperature of about 60° F. and 32 grains of moisture vapor per pound of dry air to a dry bulb temperature of about 48° F. and a moisture content of about 47 grains of water vapor per pound of dry air.

The apparatus of FIG. 4, operated as described above, has been found to require approximately 150 Btu per pound of water removed, turbine efficiency 80 percent, for regeneration of the aqueous lithium chloride solution. It has been determined that this apparatus has a coefficient of performance of 2.8.

Figure 5:
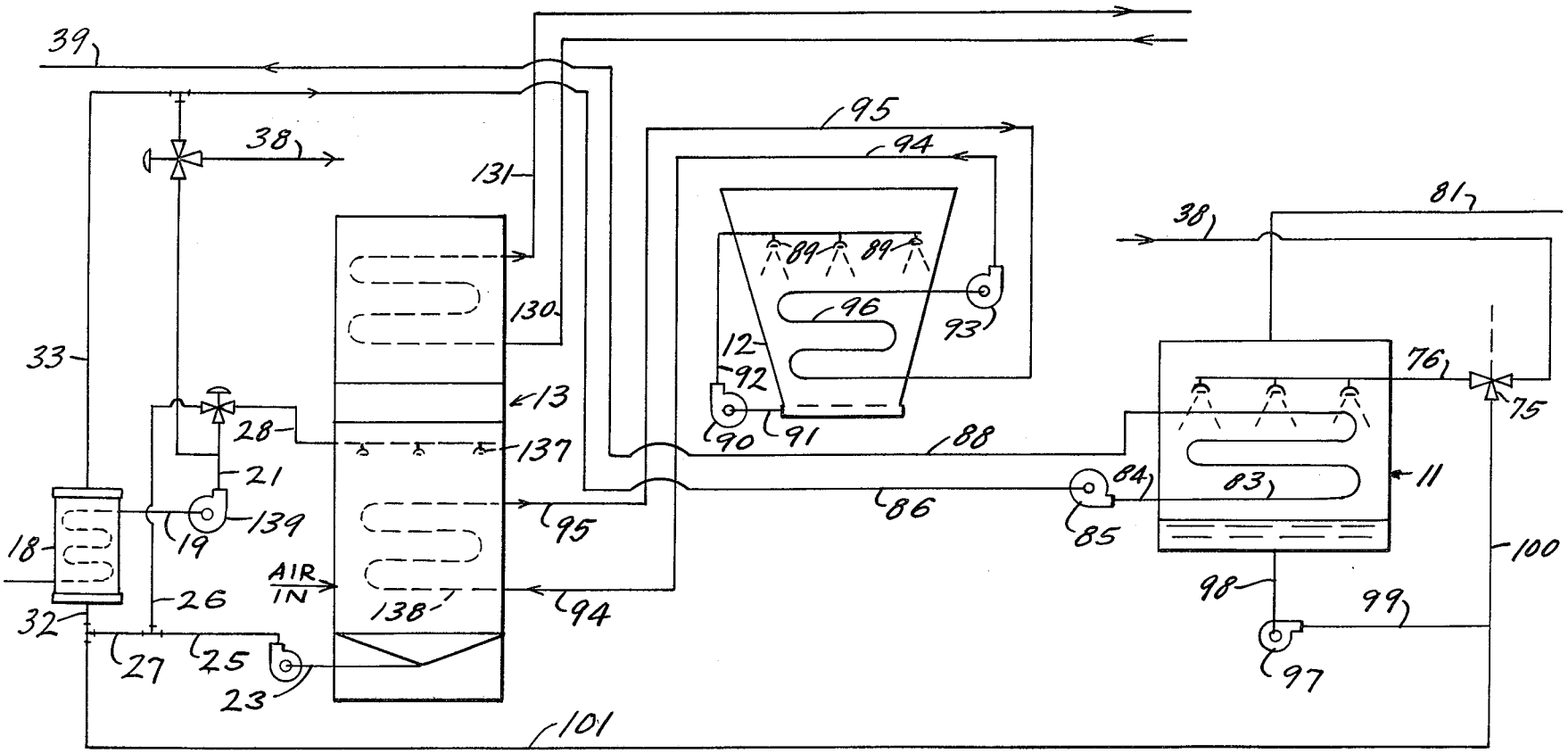
FIG. 5 is a schematic diagram showing a portion of apparatus similar to that of FIGS. 1 and 2 but differing in that the FIG. 5 apparatus includes means for transferring heat of sorption to dilute hygroscopic solution to assist in the regeneration thereof.

Referring to FIG. 5, apparatus shown fragmentarily is identical with the apparatus of FIGS. 1 and 2, as indicated by the use of the same reference numerals, except as hereinafter described. The FIG. 5 apparatus differs principally in that the coil 87 (FIG. 1) has been omitted from the evaporative cooler 12; the pump 85 has been reversed; and the connection between the lines 33 (FIG. 2) and 39 has been eliminated. Instead, referring again to FIG. 5, the line 33 is connected directly to the line 86, while the line 88 is connected directly to the line 39. As a consequence, heat of sorption from the absorber 11 is transferred to dilute hygroscopic solution from the line 33, and dilute hygroscopic solution that has been heated in the absorber 11 is delivered to the line 39, from whence it flows as previously described with reference to FIGS. 1 and 2 for regeneration.

The apparatus of FIGS. 1 and 2 includes both refrigeration apparatus and dehumidification apparatus, both of which make use of a hygroscopic solution, e.g. of lithium chloride in water. It will be appreciated that the refrigeration portion of the apparatus can be used independently of the dehumidification portion and, vice versa, that the dehumidification portion can be used independently. For example, the chilled water in the line 130 can merely be circulated through a sensible cooling coil over which air to be conditioned is circulated. Similarly, chilled water from conventional refrigerating apparatus can be circulated through the coil 129, while evaporatively cooled water from any tower is circulated through the coil 30.

What we claim is:

1. Apparatus for conditioning air comprising in combination, a chemical dehumidifier including means for spraying a hygroscopic solution in contact with air circulated therethrough, a thin film vapor compressor comprising at least one evaporating surface, a condensing surface opposite each evaporating surface, an enclosure for said evaporating and condensing surfaces, said enclosure being operable to form at least one lower pressure chamber containing said evaporating surface and at least one higher pressure chamber containing said condensing surface, a vapor pump having an inlet operatively connected to each of said lower pressure chambers and a discharge operatively connected to each of said higher pressure chambers, means for circulating dilute hygroscopic solution from said chemical dehumidifier to said vapor compressor and for flowing the dilute solution in a thin film on said evaporating surface, means for collecting concentrated hygroscopic solution which is not vaporized from said evaporating surface, for withdrawing the concentrated solution from said lower pressure chamber and for circulating the withdrawn concentrated solution to said chemical dehumidifier for spraying therein, and means for transferring heat from said chemical dehumidifier to a heat sink.

2. Apparatus for conditioning air, as set forth in claim 1, wherein said hygroscopic solution is a lithium salt, and wherein said means for circulating the withdrawn concentrated solution includes means for blending concentrated lithium salt solution circulated to said chemical dehumidifier with dilute solution recirculated therefrom and for delivering the resulting blend for spraying therein.

3. Apparatus for conditioning air, as set forth in claim 1, wherein said condensing surface condenses water vapor evaporated from the dilute hygroscopic solution in said lower pressure chamber, and further including means for circulating said condensed water for indirect heat transfer with the dilute hygroscopic solution circulated from said chemical dehumidifier to said lower pressure chamber.

4. Apparatus for conditioning air comprising in combination, an evaporator including means for spraying water through an air space, an absorber having an air space in closed communication with the air space of said evaporator, said absorber including means for spraying a hygroscopic solution through the air space therein, a thin film vapor compressor comprising at least one evaporating surface, a condensing surface opposite and in thermal conduction with each evaporating surface, an enclosure for said evaporating and condensing surfaces, said enclosure being operable to form at least one lower pressure chamber containing said evaporating surface and at least one higher pressure chamber containing said condensing surface, a vapor pump having an inlet operatively connected to each of said lower pressure chambers and a discharge operatively connected to each of said higher pressure chambers, means for circulating dilute hygroscopic solution from said absorber to said vapor compressor and for flowing the dilute solution in a thin film on said evaporating surface, means for collecting concentrated hygroscopic solution which is not vaporized from said evaporating surface, for withdrawing the concentrated solution from said enclosure and for circulating the withdrawn concentrated solution to said absorber for spraying therein and means for transferring heat from said absorber to a heat sink.

5. Apparatus for conditioning air, as set forth in claim 4, wherein said heat transferring means includes an indirect heat exchanger located within said absorber air space, cooling tower means for transferring heat from a coil to a fluent discharge therefrom, and means for circulating a heat transfer fluid from said indirect heat exchanger to said coil and said cooling tower.

6. Apparatus for conditioning air, as set forth in claim 4, wherein said evaporator further includes an indirect heat exchange coil within said air space, means for circulating a heat transfer fluid to be chilled through said heat exchange coil, and indirect heat exchange means for transferring heat from air circulated therethrough to the chilled heat transfer fluid.

7. Apparatus for conditioning air, as set forth in claim 4, wherein said condensing surface condenses water vapor evaporated from the dilute hygroscopic solution in said lower pressure chamber, and further including means for circulating said condensed water for indirect heat transfer with the dilute hygroscopic solution circulated from said absorber and thence to said evaporator for spraying therein.

8. Apparatus for conditioning air comprising in combination, a chemical dehumidifier including means for spraying a hygroscopic solution in contact with air circulated therethrough, an evaporator including means for spraying water through an air space, an absorber having an air space in closed communication with the air space of said evaporator, said absorber including means for spraying a hygroscopic solution through the air space therein, a thin film vapor compressor comprising at least one evaporating surface, a condensing surface opposite each evaporating surface, an enclosure for said evaporating and condensing surfaces, said enclosure being operable to form at least one lower pressure chamber containing said evaporating surface and at least one higher pressure chamber containing said condensing surface, a pump having an inlet operatively connected to each of said lower pressure chambers and a discharge operatively connected to each of said higher pressure chambers, means for circulating dilute hygroscopic solution from said chemical dehumidifier and from said absorber to said vapor compressor and for flowing the dilute solution in a thin film on said evaporating surfaces, means for collecting concentrated hygroscopic solution which is not vaporized from said evaporating surfaces, for withdrawing the concentrated solution from said enclosure and for circulating the withdrawn concentrated solution to said chemical dehumidifier and to said absorber for spraying therein, and means for transferring heat from said absorber to a heat sink.

9. Apparatus for conditioning air, as set forth in claim 8, and further including means for transferring heat from said chemical dehumidifier to said evaporator.

10. Apparatus for conditioning air, as set forth in claim 8, and further including means for transferring heat from said chemical dehumidifier to a heat sink.

11. Apparatus for conditioning air, as set forth in claim 10, and further including means for transferring heat from dehumidified air circulated through said chemical dehumidifier to said evaporator.

12. Apparatus for conditioning air, as set forth in claim 11, wherein said condensing surface condenses water vapor evaporated from the dilute hygroscopic solution in said lower pressure chamber, and further including means for circulating said condensed water for indirect heat transfer with the dilute hygroscopic solution circulated from said absorber and said chemical dehumidifier and thence to said evaporator for spraying therein.

13. Apparatus for regenerating a dilute aqueous sorbent solution circulated from a chemical dehumidifier comprising an evaporating surface area enclosed within a lower pressure chamber for heating and concentrating the dilute aqueous sorbent solution, a condensing surface area enclosed within a higher pressure substantially chamber in heat transfer relationship through a thermally conducting separator with said evaporating surface area, means for flowing a dilute sorbent on said lower pressure area, and means for withdrawing vapor phase material from said lower pressure chamber at a first given pressure less than atmospheric and for introducing the withdrawn vapor phase material into said higher pressure chamber at a second given pressure higher than the first given pressure, the first given pressure being sufficiently low that water is vaporized from the dilute aqueous sorbent solution on said evaporating surface area, and the second given pressure being sufficiently high that water vapor is condensed on said condensing surface area therein, whereby substantially all of the latent heat of vaporization of water condensed on said condensing surface area is transferred from said condensing area to said evaporating surface area and, from thence, to the aqueous sorbent solution being concentrated.

14. Apparatus, as set forth in claim 13, and further including an indirect heat exchanger through which the dilute aqueous sorbent solution is circulated prior to heating and concentrating in said lower pressure chamber, and means for circulating condensed water from said higher pressure chamber through said indirect heat exchanger for preheating the dilute aqueous sorbent solution.

15. Air conditioning apparatus comprising an area enclosed within a first chamber for heating and concentrating a cool dilute aqueous sorbent solution, a condensing area enclosed within a second chamber in heat transfer relationship through a thermally conducting heat exchange surface with said first-mentioned area, means for flowing a dilute sorbent on said first area, and means for withdrawing vapor phase material from the first chamber at a first given pressure less than atmospheric and for introducing the withdrawn vapor phase material into the second chamber at a second given pressure higher than the first given pressure, the first given pressure being sufficiently low that water is vaporized from the dilute aqueous sorbent solution on said heating and concentrating area, and the pressure in the second chamber being sufficiently high that water vapor is condensed on said condensing area therein, whereby substantially all of the latent heat of vaporization of water condensed on said condensing area is transferred from said condensing area to said first area and, from thence, to dilute aqueous sorbent solution.

* * * * *

UNITED STATES PATENT AND TRADEMARK OFFICE

CERTIFICATE OF CORRECTION

PATENT NO. : 4,171,624

DATED : October 23, 1979

INVENTOR(S) : Gershon Meckler and Milton Meckler

It is certified that error appears in the above-identified patent and that said Letters Patent are hereby corrected as shown below:

Column 10, line 15, delete "substantially".

Signed and Sealed this

*Fourth* Day of *March 1980*

[SEAL]

*Attest:*

SIDNEY A. DIAMOND

*Attesting Officer*

*Commissioner of Patents and Trademarks*